United States Patent [19]

Reesman

[11] Patent Number: 5,014,446

[45] Date of Patent: May 14, 1991

[54] APPARATUS FOR HEATING AN ARTICLE

[76] Inventor: Russell B. Reesman, 561 Briody St., Burlington, Wis. 53105

[21] Appl. No.: 488,891

[22] Filed: Mar. 5, 1990

[51] Int. Cl.[5] ..... F26B 9/06

[52] U.S. Cl. ..... 34/151; 34/197; 34/202; 34/215; 34/239

[58] Field of Search ..... 34/151, 237, 239, 158, 34/157, 233, 225, 215

[56] References Cited

U.S. PATENT DOCUMENTS

| | | | |
|---|---|---|---|
| 3,576,079 | 4/1971 | Hauser | 34/151 |
| 3,866,336 | 2/1975 | Bereza | 34/239 |
| 4,205,460 | 6/1980 | Taylor | 34/215 |
| 4,304,053 | 12/1981 | Kellerhols et al. | 34/225 |
| 4,471,537 | 9/1984 | Meda | 34/225 |
| 4,625,432 | 12/1986 | Baltes | 34/202 |
| 4,750,276 | 6/1988 | Smith et al. | 34/197 |

*Primary Examiner*—Henry C. Yuen

*Attorney, Agent, or Firm*—Andrus, Sceales, Starke & Sawall

[57] ABSTRACT

A device for heating an article such as a towel or the like comprises an enclosure and a heating device for providing heated air under positive pressure to the interior of the enclosure. A support in the form of a rack is arranged in the interior of the enclosure, dividing the enclosure into an upper volume and a lower volume. The towel is adapted for placement onto the upper surface of the rack, and cooperates with the lower wall of the enclosure to define a lower passage within which the heated air under positive pressure is received. Vent openings are provided in the upper portion of the enclosure for providing a bottom-to-top flow path for air supplied to the enclosure, with the towel being disposed in the flow path, and thereby heated by air circulating therethrough.

6 Claims, 1 Drawing Sheet

APPARATUS FOR HEATING AN ARTICLE

BACKGROUND AND SUMMARY

This invention relates to an apparatus and method for heating of an article, such as a towel or the like.

It is an object of the present invention to provide a towel warming device which is relatively simple in construction and operation.

It is further an object of the invention to provide a towel warming device which efficiently and effectively warms a towel in a relatively short period of time.

In accordance with the invention, a device for heating an article such as a towel or the like comprises an enclosure defined by a plurality of walls. Access means is associated with the enclosure for providing access to the interior thereof. In one embodiment, the access means may comprise a removable top portion of the enclosure. Support means is provided in the interior of the enclosure onto which the article is placeable. The support means divides at least a portion of the enclosure into an upper volume and a lower volume, and is constructed so as to provide communication between the upper volume and the lower volume. When the towel is placed onto the support means, the communication between the upper and lower volumes of the enclosure is cut off along the length of the article, and the underside of the article is exposed to the lower volume of the enclosure. Heating means is provided for introducing heated air into the lower volume of the enclosure. When the towel is placed onto the support means, the towel is exposed to heated air provided by the heating means to the lower volume of the enclosure, thereby to heat the towel.

In a preferred embodiment, the support means comprises a rack extending between spaced walls of the enclosure. The heating means preferably comprises a forced air device for introducing heated air under positive pressure to the lower volume of the enclosure. Vent means is preferably associated with the upper volume of the enclosure for exhausting air therefrom. In this manner, a bottom-to-top air flow pattern is established, with the towel being placed in the air flow path so as to collect heat from the air introduced into the enclosure. The forced air heating device preferably has a nozzle which extends into the lower volume of the enclosure, and the end of the nozzle is preferably disposed below the rack means.

BRIEF DESCRIPTION OF THE DRAWINGS

The drawings illustrate the best mode presently contemplated of carrying out the invention.

In the drawings.

DETAILED DESCRIPTION OF THE PREFERRED EMBODIMENT

Figure 1:
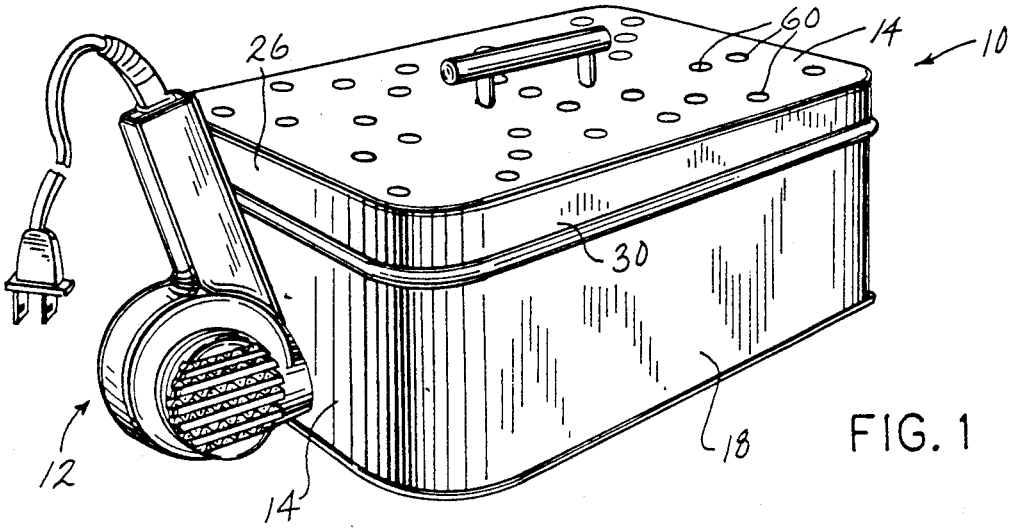
FIG. 1 is a perspective view of an assembled towel warming device constructed according to the invention.

As shown in FIG. 1, a towel warming device broadly includes an enclosure 10 and a forced air heating device 12. Enclosure 10 generally includes a bottom portion having a pair of spaced end walls 14, 16 (FIG. 2), a pair of spaced side walls 18, 20 (FIG. 3), and a bottom wall

Figure 2:
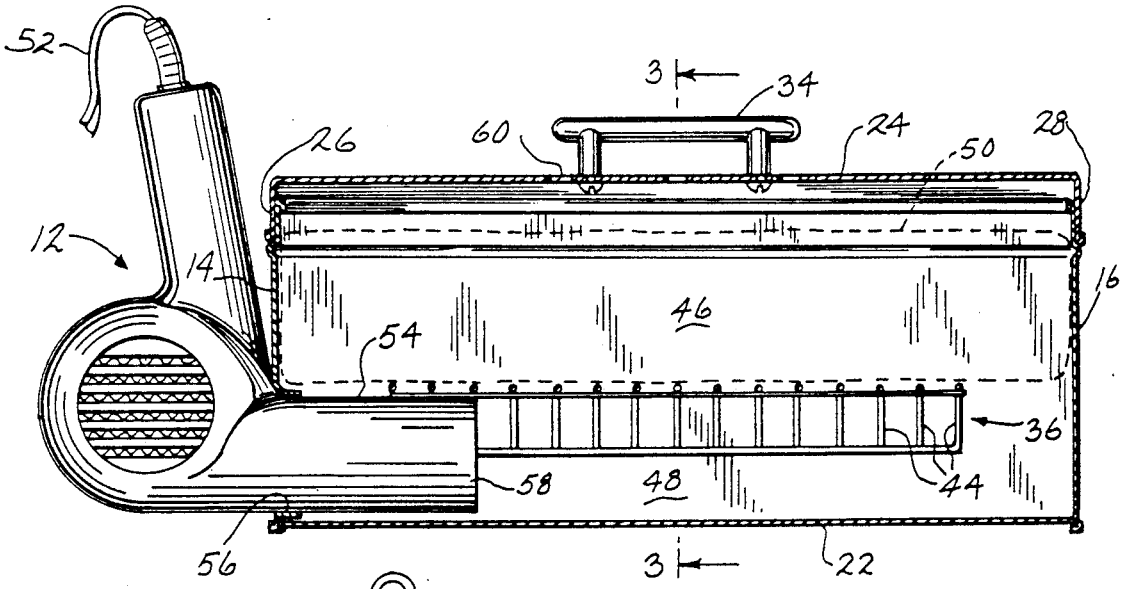
FIG. 2 is a longitudinal cross-sectional view of the device of FIG. 1.
Figure 3:
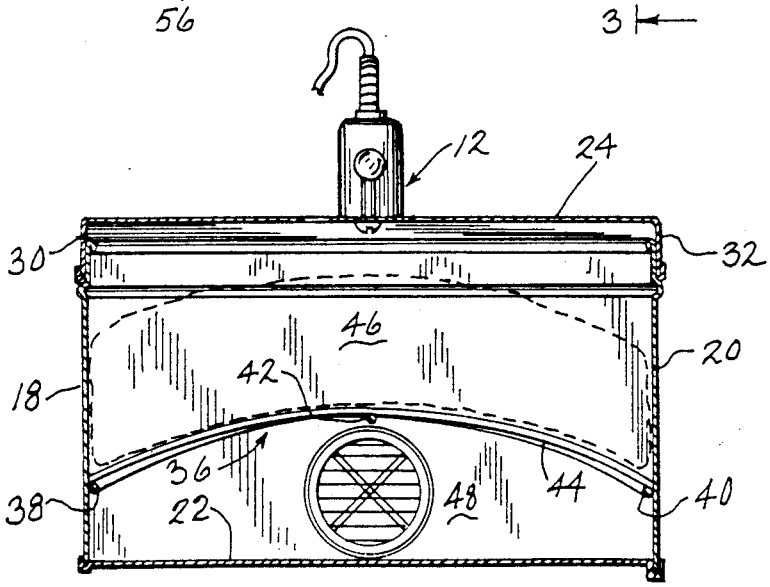
FIG. 3 is a transverse cross-sectional view taken generally along line 3—3 of FIG. 2.

22 (FIGS. 2, 3). Walls 14–22 of enclosure 10 may be constructed of any satisfactory material. As shown, walls 14–22 are constructed of formed sheet metal.

Enclosure 10 further includes an upper portion defined by an upper wall 24, depending end walls 26, 28 (FIG. 2) and depending side walls 30, 32 (FIG. 3). Like the walls forming the lower portion of enclosure 10, walls 24–32 may be constructed of any satisfactory material. As shown, however, walls 32 are constructed of formed sheet metal.

The upper portion of enclosure 10 is adapted to be removable from the lower portion of enclosure 10, in a manner as is known. A handle assembly 34 is secured to upper wall 24 of the upper portion of enclosure 10 for facilitating such removal. When the upper portion of enclosure 10 is in place on the lower portion of enclosure 10, a defined interior volume of enclosure 10 is provided.

A rack assembly 36 is positioned in the interior of enclosure 10. Rack assembly 36 includes a pair of side members 38, 40 and a central member 42, which support a plurality of cross members shown at 44. As shown in FIG. 3, rack assembly 36 is provided with an arcuate cross-sectional shape, wherein its side members 38, 40 are disposed at an elevation lower than that of central member 42.

Rack assembly 36 serves to divide the interior of enclosure 10 into an upper volume 46 and a lower volume 48. Upper volume 46 and lower volume 48 are in free communication with each other through the spaces provided between members 38–44 of rack assembly 36.

A towel, shown in phantom at 50, is adapted to be placed into the interior of enclosure 10. Towel 50 is supported by rack assembly 36 along the length of rack assembly 36. As shown, towel 50 extends throughout substantially the entire length and width of enclosure 10. Referring to FIG. 2, portions of towel 50 overhang the ends of rack assembly 36 adjacent end walls 14, 16 of enclosure 10. When towel 50 is placed on rack assembly 36, its bulk is disposed within upper volume 46 of the interior of enclosure 10, and communication between upper volume 46 and lower volume 48 is cut off along the length of towel 50. When this occurs, a lower passageway is defined in lower volume 48 by lower wall 22 and the underside of towel 50 as supported by rack assembly 36.

Forced air heating device 12 acts to provide heated air under positive pressure to lower volume 48 of enclosure 10. Referring to FIGS. 1 and 2, heating device 12 is an electrically operated appliance, and may be in the form of a commercially available conventional hair dryer or the like. A power cord 52 is provided for supplying electric power to device 12, and a switch (not shown) is associated with device 12 for providing actuation thereof.

Heating device 12 includes a nozzle 54 which extends through an opening 56 formed in end wall 14 of enclosure 10. Nozzle 54 includes a discharge outlet 58, through which heated air is discharged in response to operation of heating device 12. Discharge outlet 58 is in communication with lower volume 48 of enclosure 10. As shown in FIG. 2, nozzle 54 extends into the interior of enclosure 10 a sufficient distance such that discharge outlet 58 thereof is disposed below rack assembly 36. With this arrangement, when towel 50 is placed into the interior of enclosure 10 so that the lower passage is defined within lower volume 48 as described previously, heated air discharged through discharge outlet 58 of heating device 12 is supplied to the lower passage.

Referring to FIG. 1, upper wall 24 of the upper portion of enclosure 10 is provided with a series of vent openings 60. Vent openings 60 exhaust air from upper volume 46 of enclosure 10 when heated air under positive pressure is provided to lower volume 48 of enclosure 10 by heating device 12. In this manner, a bottom-to-top air flow path is defined with towel 50 disposed therein, acting somewhat as a filter for air passing from lower volume 48 to upper volume 46. The filter effect of towel 50 allows towel 50 to be heated by heat contained within the circulating air, with the air thereafter being discharged from enclosure 10 through vent openings 60.

It has been found that the construction described above provides a highly satisfactory and efficient means for warming a towel. It is to be appreciated, of course, that any other satisfactory article could be warmed by the structure so described.

The invention further contemplates an enclosure adapted for use in an article heating device in accordance with the above-noted description, but with heating device 12 being removable therefrom. Heating device 12 is removable from enclosure 10 by withdrawing nozzle 54 out of opening 56 formed in side wall 14. Conversely, heating device 12 can be placed back into position by inserting nozzle 54 into opening 56. In this manner, heating device 12 may be removed and used for other purposes, as is known.

The invention further contemplates a method of heating an article, substantially in accordance with the foregoing description.

In a prototype of the invention constructed according to the drawing figures, and utilizing a two-setting heating device 12 providing "high" and "low" settings, it has been found that a temperature of approximately 165° F. is imparted to towel 50 utilizing the "low" setting, and a temperature of approximately 220° F. imparted when using the "high" setting.

Various alternatives and embodiments are contemplated as being within the scope of the following claims, particularly pointing out and distinctly claiming the subject matter regarded as the invention.

I claim:

1. A device for heating an article, comprising:

an enclosure defined by a plurality of spaced walls;

access means associated with said enclosure for providing access to the interior thereof;

rack means extending between said spaced walls of said enclosure onto which said article is placeable, said rack means dividing at least a portion of said enclosure into an upper volume and a lower volume, said rack means being constructed so as to provide free communication between the upper and lower volumes of said enclosure when said article is not placed onto said rack means;

a nozzle extending into the lower volume of said enclosure for introducing under positive pressure heated air into the lower volume of said enclosure, wherein the end of said nozzle is disposed below said rack means for discharging heated air into the lower volume of said enclosure; and vent means associated with the upper volume of said enclosure for venting air therefrom;

wherein, when said article is placed onto said rack means, the free communication between the upper and lower volumes of said enclosure is cut off by said article so as to expose said article to heated air provided by said nozzle within the lower volume of said enclosure to heat said article.

2. The device of claim 1, wherein said rack means is arranged within said enclosure so as to be lower at its ends adjacent the walls of said enclosure than at its center.

3. The device of claim 1, wherein said nozzle extends through a side wall of said enclosure.

4. The device of claim 1, wherein said access means comprises a removable top portion of said enclosure.

5. The device of claim 1, wherein said heating means is selectively actuable.

6. A device for heating an article, comprising:

an enclosure defined by a plurality of spaced walls;

access means associated with said enclosure for providing access to the interior thereof;

rack means extending between said spaced walls of said enclosure onto which said article is placeable, said rack means cooperating with a lower wall of said enclosure to define a lower passageway, said rack means being constructed so as to allow communication along the length thereof between said lower passageway and said article when placed onto said rack means;

a nozzle extending into the lower volume of said enclosure for introducing under positive pressure heated air into the lower passageway, wherein the end of said nozzle is disposed below said rack means for discharging heated air into the lower volume of said enclosure; and vent means associated with the upper volume of said enclosure for venting air therefrom;

wherein, when said article is placed onto said rack means, the communication between said lower passageway and said article exposes said article to heated air provided by said heating means to heat said article.

* * * * *